US005810148A

United States Patent [19]

Schoeneweiss

[11] Patent Number: 5,810,148

[45] Date of Patent: Sep. 22, 1998

[54] TREAD ELEMENT FOR ESCALATORS AND TRAVELATORS

[75] Inventor: Klaus Schoeneweiss, Hattingen, Germany

[73] Assignee: O&K Rolltreppen GmbH & Co. KG, Hattigen, Germany

[21] Appl. No.: 863,353

[22] Filed: May 27, 1997

[30] Foreign Application Priority Data

May 24, 1996 [DE] Germany ..... 296 09 299 U

[51] Int. Cl.[6] ..... B66B 23/12

[52] U.S. Cl. ..... 198/333

[58] Field of Search ..... 198/333

[56] References Cited

U.S. PATENT DOCUMENTS 4,295,556 10/1981 Saito et al. ..... 198/333 X
4,362,232 12/1982 Saito et al. ..... 198/333
5,150,780 9/1992 Fischer ..... 198/333

FOREIGN PATENT DOCUMENTS 124885 10/1978 Japan ..... 198/333

*Primary Examiner*—James R. Bidwell
*Attorney, Agent, or Firm*—Spencer & Frank

[57] ABSTRACT

A tread element for escalators and travelators includes a treadplate for receiving persons to be transported. The treadplate includes at least one outer portion having a plurality of recesses. A plurality of individual moldings are disposed juxtaposed to one another in the at least one outer portion. Each molding includes a plurality of stud-shaped lugs on a side of the molding facing the treadplate and passing through a corresponding one of the recesses in the at least one outer portion of the treadplate for centering the molding relative to the treadplate. Each of the plurality of moldings has edge portions. The edge portions of moldings adjoining each other include projections that at least partially overlap one another. The lugs each have a free end surface including a receiving opening for receiving a screw.

11 Claims, 4 Drawing Sheets

TREAD ELEMENT FOR ESCALATORS AND TRAVELATORS

CROSS-REFERENCE TO RELATED APPLICATIONS

The present application claims the right of priority with respect to Application No. 296 09 299.1, filed in Germany on May 24, 1996, the disclosure of which is incorporated herein by reference.

BACKGROUND OF THE INVENTION

The invention relates to a tread element for escalators and travelators including a treadplate for receiving persons to be transported. Such a treadplate has outer portions, at least one of which includes a molding made, for example, of a plastics material. Such a molding includes several stud-shaped lugs on its treadplate side which can pass through corresponding recesses in the region of the treadplate and, on the side facing away from the treadplate, are fixed relative to the treadplate by connecting elements.

German Patent document DE-A 35 30 263 discloses a tread element for travelators or escalators including a treadplate for receiving the persons to be transported, this plate being provided with at least one edge molding secured in the region of at least one of its longitudinal edges. Along at least one of its two longitudinal edges the edge molding under clasps a part of the treadplate and is fixedly connected to the treadplate between its two longitudinal edges by means of additional fastener means.

European patent application EP-A 449 780 discloses another tread element for escalators and travelators wherein, to affect a reliable connection between edge moldings inserted in the treadplate of a tread element which is producible by die casting, each of the edge moldings comprises on its underside a spring at least along its two longitudinal edges. The cross-sections of the latter two have the shape of a parallelogram having equal angles to each other or a trapezium and engage in the manner of a tongue-and-groove connection in corresponding grooves in the treadplate. Furthermore, these edge moldings are provided on their underside with at least two cast arresting studs extending downwards and through the adjoining treadplate. At the free ends of arresting studs, which protrude downwards from the treadplate, a clamping ring flexibly supported by the underside of the treadplate is firmly clamped in place.

The drawback in this arrangement is that the edge molding over time becomes loose due to the use of a springy clamping ring as the connecting element. This ultimately results in the edge molding lifting off as a result of which it poses an accident hazard for passengers.

SUMMARY OF THE INVENTION

It is an object of the invention to overcome the drawbacks of the known prior art, particular with respect to European application EP-A 449 780 and to design a particularly cost-effective mechanism for fastening the edge moldings.

The above and other objects are accomplished in accordance with the invention by the provision of a tread element for escalators and travelators, comprising: a treadplate for receiving persons to be transported, the treadplate including at least one outer portion having a plurality of recesses; a plurality of individual moldings disposed juxtaposed to one another in the at least one outer portion, each molding including a plurality of stud-shaped lugs on a side of the molding facing the treadplate and passing through a corresponding one of the recesses in the at least one outer portion of the treadplate, each of the plurality of moldings having edge portions, the edge portions of moldings adjoining each other including lugs that at least partially overlap one another, the lugs each having a free end surface including a receiving opening for receiving a screw.

Due to the special shape of the studs having core or blind holes in the region of the undersides of the edge moldings in conjunction with the through-holes necessary therefore in the region of the treadplates, the screw, for example a special screw configured for self-tapping, can be fitted with a suitable power screwdriver in the blind hole, as a result of which the connection is ultimately produced by material displacement, i.e. by a lateral clamping action. The connection is shock and vibration-proof so that any unwanted release of the edge molding from the treadplate can be reliably excluded.

The subject matter of the novel aspect will now be described on the basis of an example embodiment with respect to the accompanying drawings.

DETAILED DESCRIPTION OF THE INVENTION

Figure 1:
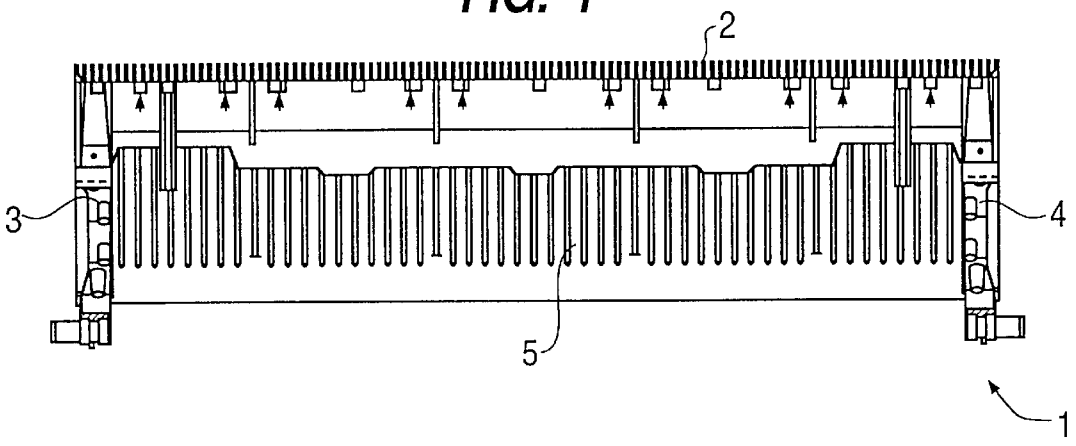
FIG. 1 is a side view of a tread element for an escalator.
Figure 2:
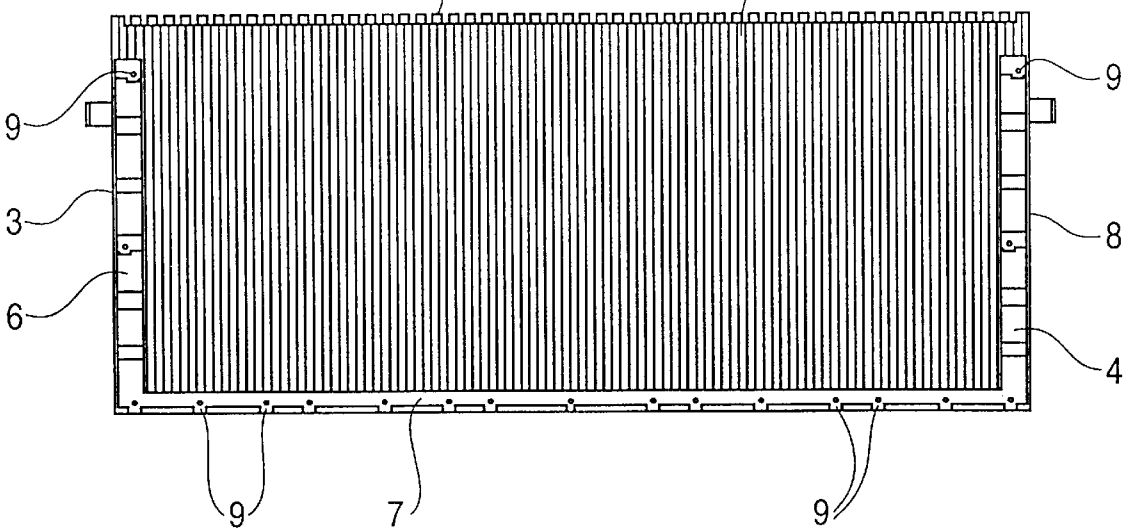
FIG. 2 is a top view of the tread element shown in FIG. 1.

FIGS. 1 and 2 show side and top views a tread element 1 configured as a step for an escalator (not shown). As an alternative, of course, the tread element may be provided for a travelator. The tread element 1 comprises a treadplate 2, side portions 3,4 for receiving rollers (not shown) as well as a backing element 5. Treadplate 2 has recessed outer portions 6, 7, 8 serving to receive the edge moldings described in the following figures. The treadplate outer portions 6, 7, 8 comprise a plurality of through-holes or recesses 9.

Figure 3:
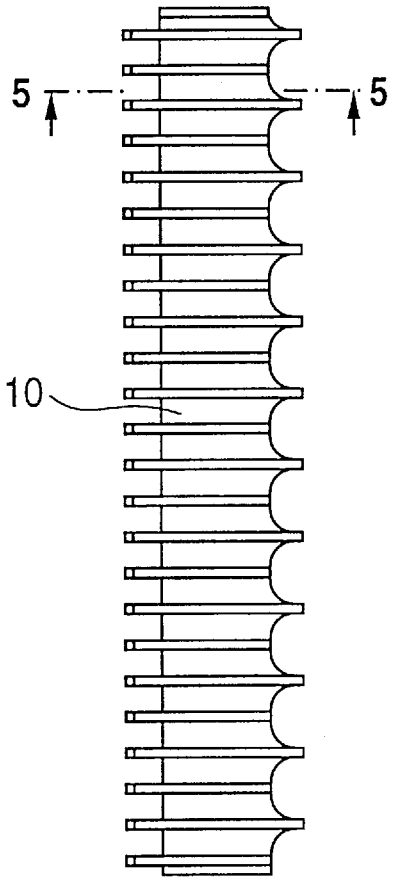
FIG. 3 is a partial top view of a portion of an edge molding according to the invention.
Figure 4:
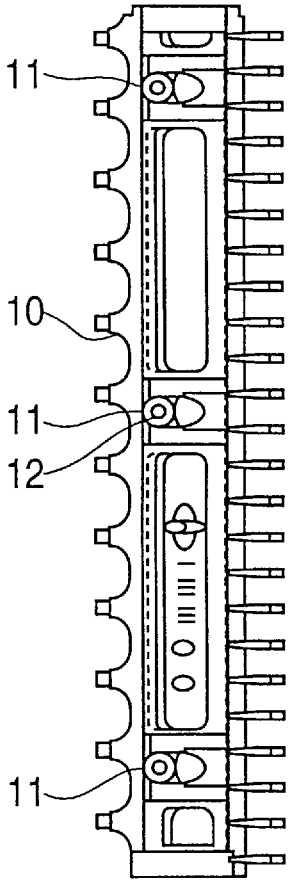
FIG. 4 is a view of the bottom of the portion of the edge molding shown in FIG. 3.
Figure 5:
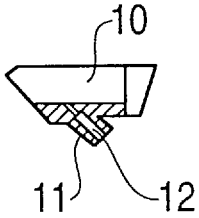
FIG. 5 is a cross-section along line 5—5 in FIG. 3.

FIGS. 3 to 5 show top, bottom and sectional views, respectively, of an edge molding 10 provided with a profile equivalent to that of the treadplate. On the underside (FIG. 4) of edge molding 10 several stud-shaped lugs 11 are provided. Each lug 11 incorporates a blind hole 12. The edge moldings 10 preferably consist of a tinged plastics material.

Figure 6:
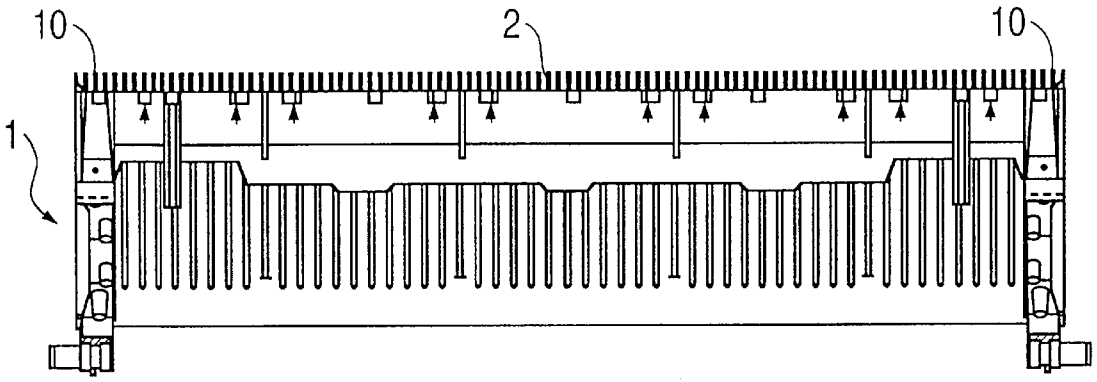
FIGS. 6 and 7 are views of a tread element corresponding to those shown in FIGS. 1 and 2, respectively, provided with edge moldings as shown in FIGS. 3 to 5.
Figure 7:
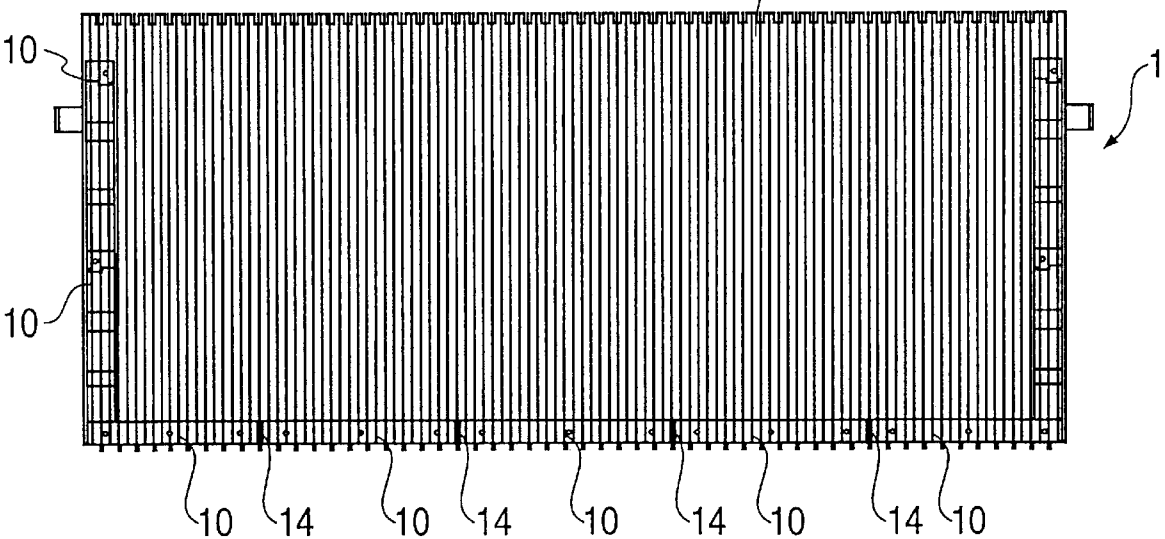

FIGS. 6 and 7 show the tread elements 1 illustrated in FIGS. 1 and 2, here, however, equipped with the edge moldings 10 as shown in FIGS. 3 to 5.

Figure 9A:
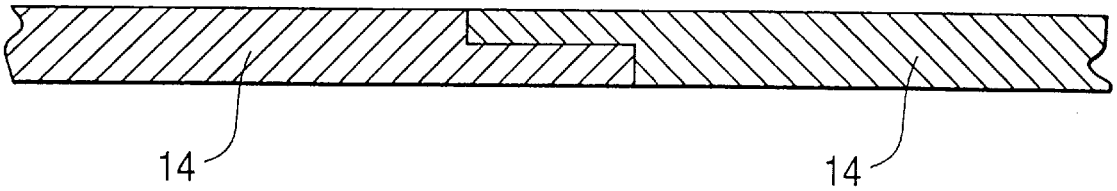
FIGS. 9*a*–9*c* are partial sectional views showing overlapping projections of adjoining moldings.
Figure 9B:
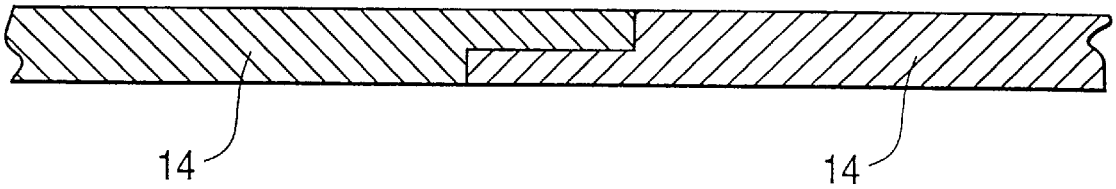
Figure 9C:
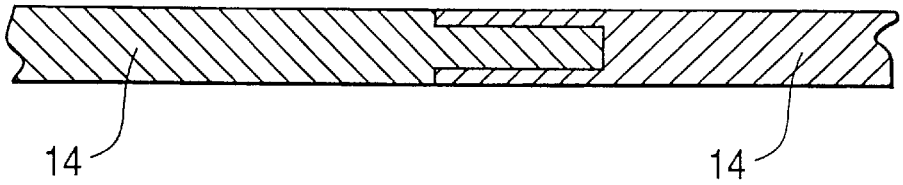

It is evident, particularly from FIG. 7, that edge moldings 10 are provided in the region of their juxtaposed edge portions with projections 14 overlapping each other at least in part. FIGS. 9*a*, 9*b* and 9*c* illustrate three variations of the overlapping projections, wherein in each case the edge portion of juxtaposed moldings has a projection and a free space or cavity for receiving the projection of the adjoining molding. This arrangement avoids gaps between individual moldings and enables minor tolerances to be compensated in fitting without the overall appearance of the tread element 1 being negatively affected.

The edge moldings 10 are designed so that a surface area is formed flush with the treadplate 2.

Figure 8:
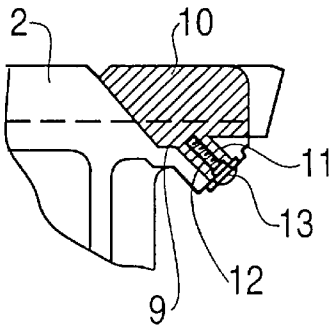
FIG. 8 is a partial sectional view of a connecting portion between an edge molding and a tread element in accordance with the invention.

FIG. 8 shows a partial portion of a treadplate 2 together with the edge molding 10 inserted therein. As already indicated, treadplate 2 is provided with a plurality of through-holes 9 through which the stud-shaped lugs 11 are inserted. By means of a suitable tool, a screw, preferably a plastics displacing screw 13, having a special thread (not shown), is inserted in blind hole 12. The connection between the edge molding 10 and the treadplate is produced by corresponding material displacement as the screw is inserted.

Preferably, the screws include a plastics-displacing thread of a predetermined thread pitch, for example, a pitch of approximately 30 degrees. Desirably, the screws each have a shank which is other than circular. Preferably, the receiving openings comprise blind holes of a predetermined length and diameter, and the blind holes are countersunk. Additionally, the moldings preferably include centering elements for centering the moldings relative to the treadplate. Further, in a preferred embodiment, the moldings are located at least in a region of a longitudinal edge of the treadplate outside of the edge profile of the treadplate.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A tread element for escalators and travelators, comprising:

a treadplate for receiving persons to be transported, the treadplate including at least one outer portion having a plurality of recesses;

a plurality of individual moldings disposed juxtaposed to one another in the at least one outer portion, each molding including a plurality of stud-shaped lugs on a side of the molding facing the treadplate and passing through a corresponding one of the recesses in the at least one outer portion of the treadplate, each of the plurality of moldings having edge portions, the edge portions of moldings adjoining each other including projections that at least partially overlap one another, the lugs each having a free end surface including a receiving opening for receiving a screw.

2. The tread element as set forth in claim 1, wherein said at least one outer portion includes a plurality of outer portions and each of said outer portions includes a plurality of said juxtaposed moldings.

3. The tread element as set forth in claim 2, wherein the plurality of outer portions include a longer outer portion disposed between two shorter outer portions and the juxtaposed moldings in the longer portion each include a free space into which the projection of the edge portion of an adjoining molding is inserted.

4. The tread element as set forth in claim 1, and further comprising self tapping screws for screwing into the receiving openings of the lugs.

5. The tread element as set forth in claim 4, wherein the molding comprises plastic and the screws include a plastics-displacing thread of a predetermined thread pitch.

6. The tread element as set forth in claim 5, wherein the thread pitch is approximately 30 degrees.

7. The tread element as set forth in claim 4, wherein the screws each have a shank which is other than circular.

8. The tread element as set forth in claim 1, wherein the receiving openings comprise blind holes of a predetermined length and diameter.

9. The tread element as set forth in claim 8, wherein the blind holes are countersunk.

10. The tread element as set forth in claim 1, wherein the moldings include centering elements for centering the moldings relative to the treadplate.

11. The tread element as set forth in claim 1, wherein the treadplate has an edge profile and the moldings are located at least in a region of a longitudinal edge of the treadplate outside of the edge profile of the treadplate.

* * * * *